United States Patent [19]

Swanson

[11] 4,210,526

[45] Jul. 1, 1980

[54] DESULFURIZING FOSSIL FUELS

[76] Inventor: Rollan Swanson, 220 California Ave., Santa Monica, Calif. 90403

[21] Appl. No.: 915,905

[22] Filed: Jun. 16, 1978

Related U.S. Application Data

[63] Continuation-in-part of Ser. No. 898,206, Apr. 20, 1978, Pat. No. 4,160,721.

[51] Int. Cl.[2] ..... C10G 19/00; C10G 34/00; C01B 17/00; C01B 17/16

[52] U.S. Cl. ..... 208/230; 208/235; 423/561 A; 423/562; 423/563; 423/571

[58] Field of Search ..... 423/242–244, 423/561 A, 562, 563, 571; 208/230, 235

[56] References Cited

U.S. PATENT DOCUMENTS

| | | | |
|---|---|---|---|
| 1,656,563 | 1/1928 | Koppe | 423/571 |
| 1,783,723 | 12/1930 | Langheinrich | 423/571 |
| 4,018,572 | 4/1977 | Swanson | 423/242 A |

*Primary Examiner*—Delbert E. Gantz
*Assistant Examiner*—Gregory A. Heller
*Attorney, Agent, or Firm*—Albert F. Kronman

[57] ABSTRACT

Hydrated alkali metal sulfides used to remove sulfur from fossil fuels to form alkali metal polysulfides which are recycled to alkali metal sulfides and elemental sulfur by thermal or thermal reduced pressure decomposition of the alkali metal polysulfides or by conversion of the hydrolysis products entirely by $H_2S$.

9 Claims, No Drawings

DESULFURIZING FOSSIL FUELS

Reference to Co-Pending Application

This application is a continuation in part of application Ser. No. 898,206 filed April 20, 1978 now U.S. Pat. No. 4,160,721.

Field of the Invention

This invention is concerned with a process for preparing alkali metal monosulfides suitable for the desulfurization of fossil fuels.

Background of the Invention

In co-pending U.S. patent application Ser. No. 898,206 filed Apr. 20, 1978, the teachings of which are incorporated herein by reference, there is disclosed and claimed a process for desulfurizing fossil fuels, in particular petroleum residues, by contacting same with at least 0.25 volume thereof of an alkali metal sulfide hydrate or hydroxide at a temperature comprised between about 120° and 325° C. from about 3 to 60 minutes and separating said residues now having a reduced sulfur content. The economics of the said desulfurization process would be markedly enhanced by an inexpensive reagent recycling process.

The main object of this invention is to provide such a recycling process.

Disclosure

Alkali metal polysulfides with an intermediate sulfur content between that of the monosulfide and that of the highest sulfur valence ($Na_2S_4$ or $K_2S_5$) are unstable in hot water and decomposed to an equilibrium state of the given alkali metal sulfides and $K_2S_5$ or $Na_2S_4$. Stepwise this decomposition may be represented as follows:

1. $4K_2S_2+8H_2O \rightarrow 3(K_2S.2.66H_2O)+K_2S_5$ potassium monosulfide hydrate
2. $4K_2S_3+5.33H_2O \rightarrow 2(K_2S.2.66H_2O)+2K_2S_5$.
3. $4K_2S_4+2.66H_2O \rightarrow (K_2S.2.66H_2O)+3K_2S_5$ The actual water content of the sulfide hydrate formed varies according to the temperature hot water of the solution.

Shown in greater detail, the reaction is illustrated below:

4. $4K_2S_2+8H_2O \rightarrow 4KOH+4KHS+4S+4H_2O$ (at 100°-150° C.)

In turn, the $4H_2O$ and the 4KHS react in a composition-decomposition equilibrium 5. $4KHS+4H_2O \rightleftarrows 4KOH+4H_2S$ The soluble atoms of sulfur react with KOH as follows:

6. $4S+6KOH \rightarrow K_2S_2O_3+2K_2S+3H_2O$

In turn, $K_2S_2O_3$, reacts with the $H_2S$, as follows:

7. $K_2S_2O_3+3H_2S \rightarrow K_2S_5+3H_2O$

The purpose of the hot water decomposition of the intermediate polysulfides is to increase the life of the reagent monosulfide hydrate before recycling is required by the formation of high sulfur content polysulfides.

The alkali metal sulfide hydrate in melt condition with no water in excess of its water of hydration does not dissolve either $K_2S_5$ or $Na_2S_4$ allowing these high sulfur content polysulfides to be separated by a liquid solid operation. Thus a melt of the anhydrous high sulfur content polysulfide is separated from the hydrate melt by a liquid liquid separation.

The separated $K_2S_5$ or $Na_2S_4$ is decomposed thermally or thermally under reduced pressures.

At one half Torricelli $K_2S_6$ at 130° C. yields $K_2S_5$ plus sulfur $K_2S_5$ at 190° C. yields $K_2S_4+S$ $K_2S_4$ at 260° C. yields $K_2S_3+S$ $K_2S_3$ at 350° C. yields a mixture of $K_2S$ and $K_2S_2+S$ $K_2S_2$ at 650° C. yields $K_2S+S$ The sodium sulfides all display instability at the melting points which are 445° C., for $Na_2S_2$, and 275° C. for $Na_2S_4$.

The potassium sulfides are all stable at their melting points at atmospheric pressure (except $K_2S_6$)

At 760 mm of mercury $K_2S_5$ yields $K_2S_4$+sulfur at 300° C.

$K_2S_4$ yields $K_2S_3+S$ at 460° C.

$K_2S_4$ yields $K_2S_3+S$ at 620° C.

$K_2S_3$ yields $K_2S_2+S$ at 780° C.

An alternative is to dissolve the polysulfides in aqueous solution and pass $H_2S$ into the solution thereby forming the hydrosulfide of the alkali metal. The alkali metal hydrosulfide neither dissolves nor reacts with sulfur in alkaline aqueous solutions, the sulfur being precipitated.

Following the separation of this precipitated sulfur the solution may be heated to both reduce the water content and to drive off $H_2S$. When one half of the $H_2S$ of the hydrosulfide present has been driven off, the alkali metal sulfide is reformed and with the proper amount of water present (depending upon the temperature and the alkali metal) the particular hydrate is formed. The $H_2S$ driven off is used to precipitate sulfur from the next batch.

Due to the diminished degree of hydrolysis encountered, as the sulfur content of polysulfides is increased, the thermal or thermal reduced pressure decomposition of high sulfur content alkali metal polysulfides may precede the formation of alkali metal hydrosulfide by treatment of alkali metal hydroxide with hydrogen sulfide, as shown in equation 4 above, In the hot water hydrolysis of the intermediate sulfur content alkali metal polysulfide, the alkali metal hydrosulfide and the alkali metal hydroxide are formed along with atomic sulfur. The atomic sulfur combines with the alkali metal hydroxide to form the alkali metal thiosulfate (equation 6). A small quantity of the atomic sulfur combined with any non-hydrolized alkali metal polysulfide to form a still higher sulfur content alkali metal polysulfide. The higher the sulfur content the less hydrolysis is exhibited. The higher the temperature of the hydrated melt the greater is the degree of hydrolysis of all the alkali metal sulfides and polysulfides.

As shown by equation 5 the alkali metal hydrosulfide is unstable in hot water and decomposes to additional alkali metal hydroxide and hydrogen sulfide in a reaction which is reversible in a closed system. The addition of hydrogen sulfide under pressure will largely convert the hydrolysis product (the alkali metal hydroxide) to the alkali metal hydrosulfide). The hydrosulfide will expel the atomic sulfur as elemental sulfur which then is removed from the system.

The hydrogen sulfide which comes from the decomposition of the hydrolysis product, (the alkali metal hydrosulfide) will react with the thiosulfate, in equation 7 to form the tetrasulfide of sodium or the pentasulfide of potassium. Only sulfur ion as the alkali metal sulfide itself with all the atomic sulfur is coordinated into sodium tetrasulfide or the potassium pentasulfide.

The aqueous tension of the remaining alkali metal monosulfide melt is less than that of sodium tetrasulfide or potassium pentasulfide. These polysulfides then exist as anhydrous melts above the melting point or as anhydrous solids below the melting point. These anhydrous solids or liquids are practically insoluble in the slightly hydrolized melts of the alkali metal monosulfide hydrates. Separation thus takes place. The fossil fuel forms the top layer, the mono sulfide forms the next layer, the bottom layer consists of the potassium pentasulfide or the sodium tetra sulfide. The bottom layer is then removed and treated. The middle layer is an excellent reagent for desulfuring additional fossil fuels. The process, beginning with a mixture of alkali metal sulfides derived following the desulfurization of the fossil fuels and the separation of the fossil fuels from the melt is as follows:

1. Pressure condensation of steam to produce hydrolysis. This hydrolysis decomposes intermediate sulfur content polysulfides and establishes an equilibrium between the alkali metal monosulfide and the sodium tetrasulfide or potassium pentasulfide. The addition of one mole of water is adequate for producing hydrolysis. This step is carried out at a selected process temperature of between 120° to 325° C.

2. The reduction of the water content of the system.

The gases produced in step 1 which are steam and $H_2S$ at a temperature above the critical pressure of water at the selected process temperature, are withdrawn from the system. The water is condensed (a) by cooling in a gas stream or (b) by compression of the gases to still higher pressure while cooling to keep the gases from heating during the compensation. The condensed water is separated and the remaining gases are returned to the system from which they came.

When the liquid water content is reduced to that of the hydrated alkali metal mono-sulfide hydrate melt, the $K_2S_5$ or $NA_2S_4$ separates in liquid or solid form depending upon the temperature.

The separated mono-sulfide melts are then used for desulfuring additional fossil fuels.

The separated potassium pentasulfide or the sodium tetrasulfide can be decomposed thermally or thermally with reduced pressures to lower sulfur content sulfides and elemental sulfur. Sodium sulfides decompose to the monosulfides beginning at 445° C. The greater the temperature, the more rapid its decomposition. Reduced pressure can be used to decompose it more rapidly at lower temperatures.

Potassium pentasulfide is decomposed to potassium trisulfides and elemental sulfur 420° C. to 460° C. At those same temperatures, when the pressures are reduced under 10 mm of mercury or less, elemental sulfur is distilled and a resulting mixture of potassium sulfide and disulfide is obtained in proportions of 2 potassium sulfide to 1 potassium disulfide. When this mixture is converted to hydrated potassium sulfide reagent a slight excess of water will convert the potassium disulfide to ¾ potassium sulfide hydrate and ¼ part potassium pentasulfide and this mixture is used as a reagent.

The separated potassium pentasulfide may also be made into a hot water solution and within a closed system sufficient hydrogen sulfide is added under pressure to convert the compound to essentially potassium hydrosulfide and free sulfur. The sulfur is then separated and the excess hydrogen sulfide is allowed to escape until a melt of the potassium sulfide hydrate, which exists at the selected process temperature (any temperature) from boiling point to critical temperature of water) is formed. The same amount of boiled off hydrogen sulfide (exactly ½) is used over and over again to throw out sulfur. The amount of water added to the system should be that needed to form that potassium sulfide hydrate which exists at the selected process temperature.

Outlined in greater detail the process of the invention includes the following steps.

1. The fossil fuel is separated from the spent alkali metal sulfide polysulfide reagent mixture at the process temperature of 120°–325° C.

2. A stoichiometric quantity (at least 1 mol) of water per mol of potassium sulfide and polysulfide is added to the reagent mix in a closed system.

3. The $H_2S$ and $H_2O$ generated are allowed to escape into a compressor at a pressure slightly above the critical pressure of water at the selected temperature of the system and the water is condensed. The uncondensed volatiles are then returned to the process system.

4. When the amount of liquid water of hydration is the same as that of the alkali metal hydrate melt, hydrated potassium pentasulfide or sodium penta sulfide precipitate.

5. The precipitated polysulfides are then removed from the bottom of the process system.

6. The potassium pentasulfide or sodium tetrasulfide are heated to 420°–460° C. under atmospheric under which conditions the elemental sulfur is immiscible.

7. The immiscible sulfur is then separated from the polysulfide liquid by a liquid-liquid separation.

8. Reduced pressures of no more than 10 mm of mercury are used to distill the rest of the removable sulfur.

9. Water is added to the mixture formed from step 8 and a slight excess of water above that of the theoretical hydrate which exists at the system is used.

10. The mixture of step 9 is next hydrated to the actual water content of the hydrate.

In practice up to 10% of the $K_2S_5$ has been left, with the hydrated melt reagent. The sulfur removed is 97½% per mol of sulfur in excess of that present as sulfide ions.

The invention is further illustrated in non-limiting fashion by the following example:

EXAMPLE

Following the removal of organic and elemental sulfur from fossil fuels by combination of these sulfur forms with alkali metal sulfide hydrates, preferably potassium sulfide hydrate, to form alkali metal polysulfide, the alkali metal polysulfide is decomposed to alkali metal sulfide hydrate and elemental sulfur.

1. 500 ml of the mixed potassium sulfide hydrate melt and potassium polysulfide was withdrawn from the process system. The mixture was at 230° C.

2. 150 grams of cold $H_2O$ was added to the mixture in a closed air-tight vessel with agitation.

3. The temperature was allowed to drop to 150° C. The gases of the system were permitted to exit the system through a tube. The gases were compressed to above the critical pressure of $H_2O$ at 150° C. and some water was condensed. The gases were returned to the mixture.

(A) Remaining petroleum residues withdrawn along with the alkali metal sulfide-polysulfide separated when the liquid $H_2O$ content of the process-system equaled that of the hydrated melt.

(B) The $K_2S_5$ was precipitated as an insoluble solid when its water content reached that of a $K_2S$ hydrate, for that temperature and pressure.

The liquid $K_2S$ hydrate was drawn off through a separating funnel, leaving lighter petroleum residues and solid $K_2S_5$.

The solid $K_2S_5$ was separated from petroleum residue by a liquid solid separation.

The separated $K_2S_5$ was divided in half relying on visual approximation. The total $K_2S_5$ had a weight of 55 grams.

One half the $K_2S_5$ was heated to 460° C. under 1 mm of mercury pressure. Sulfur was distilled leaving a mixture of $K_2S$-$K_2S_2$ after 37 minutes distillation time. A slight excess of water was added and ¾ of the $K_2S_2$ was converted into $K_2S$ hydrate and ¼ of the $K_2S_2$ converted into $K_2S_5$. The $H_2O$ content was reduced as before. The $K_2S$ hydrate was used to desulfurize additional fossil fuel while the $K_2S_5$ was added to the other half of the $K_2S_5$ being recycled.

14.25 grams of sulfur was recovered from the original half of the 55 grams of $K_2S_5$.

The $K_2S_5$ was made into a 70% aqueous solution (70% $K_2S_5$ and 30% $H_2O$) at 90° C. $H_2S$ was passed into the system contained within a closed system. Approximately 50% of the polysulfide sulfur was removed as elemental sulfur when the hydrolysis product contained insufficient KOH to form $K_2S$. The sulfur was removed. The $H_2O$ content was reduced as before and a mixture of $K_2S$-$K_2S$ hydrates resulted and 7.3 grams of elemental sulfur were recovered.

The present invention has been disclosed herein with particular respect to potassium sulfides. However, a latitude of modification, change and substitution is intended in the foregoing disclosure, and in some instances sulfides of other alkali metals will be employed in the desulfurizing process for optimum results. Accordingly, other systems and process conditions encompassed by the above disclosure are fully equivalent to those claimed hereinbelow.

What is claimed is:

1. In a process wherein petroleum residues are desulfurized by treating with at least 0.25 volume thereof of an alkali metal monosulfide hydrate reagent at a process temperature of between about 120° and 325° C. from about 3 to 60 minutes: separating said residues now having a reduced sulfur content from the corresponding alkali metal polysulfides, the improvement which comprises the steps of:

(a) separating at said process temperature a mixture of unreacted alkali metal monosulfide hydrate and alkali metal polysulfides from said desulfurized residue;

(b) hydrolizing in a closed system said polysulfides by adding to said mixture at said temperature at least one mol of water per mol of hydrate and polysulfide thereby forming steam and hydrogen sulfide;

(c) removing said steam and said hydrogen sulfide from said system thereby reducing the water content therein to that of the alkali metal monosulfide hydrate and separating the highest sulfur content polysulfide from the said hydrate.

2. The process of claim 1, further including the steps of separating said polysulfide from any said residue; heating a portion of said polysulfide to distill off sulfur thereby leaving additional monosulfide and disulfide; adding an excess of water; and dehydrating the resulting mixture to form additional reagent alkali metal monosulfide and additional alkali metal polysulfide.

3. The process of claim 1, wherein a portion of said polysulfide is treated with hydrogen sulfide in a closed system with water, the sulfur formed is removed, and the water content of the system is reduced to that of the alkali metal hydrosulfide hydrate.

4. The process of claim 3, wherein excess hydrogen sulfide is allowed to exit from the system until said water content of said system is reduced.

5. The process of calim 3, wherein the amount of said water which is added is that needed to form that monosulfide hydrate which exists at the selected proces temperature.

6. The process of claim 1, wherein said alkali metal is potassium and said reduction in water content in step (c) produces $K_2S.2H_2O$ at 150° C. or above and $K_2S.5H_2O$ below 150° C. for an empiric 2.66 and hydrated $K_2S_5$.

7. The process of claim 1, wherein said metal is sodium or potassium.

8. The process of claim 1, wherein said polysulfide is heated to about 460° C. under 1 mm of pressure to distill off sulfur and leave behind sulfides of lower sulfur content including the monosulfide of said alkali metal.

9. The process according to claim 1, wherein said alkali metal monosulfide hydrate reagent is formed by the following reactions:

$$4K_2S_2+8H_2O \rightarrow 3(K_2S.5H_2O \text{ or } 2H_2O)+K_2S_5$$

$$4K_2S_3+5.33H_2O \rightarrow 2(K_2S.2.66\ H_2O)+2K_2S_5$$

$$4K_2S_4+2.66H_2O \rightarrow (K_2S.2.66H_2O)+3K_2S_5.$$

* * * * *